US005630778A

United States Patent [19]

Barreca

[11] Patent Number: 5,630,778

[45] Date of Patent: May 20, 1997

[54] ABDOMINAL EXERCISE APPARATUS AND METHOD

[75] Inventor: Jack Barreca, Aurora, Colo.

[73] Assignee: AB-CAM, L.L.C., Denver, Colo.

[21] Appl. No.: 561,188

[22] Filed: Nov. 21, 1995

[51] Int. Cl.[6] ..... A63B 23/02

[52] U.S. Cl. ..... 482/140; 482/132; 482/142

[58] Field of Search ..... 482/10, 78, 95, 482/96, 131, 132, 133, 140, 142, 144, 148, 907, 908; 297/258, 260, 271.5, 271.6, 272.1, 272, 408; 472/135; D21/191, 193

[56] References Cited

U.S. PATENT DOCUMENTS

| | | | |
|---|---|---|---|
| 1,244,371 | 10/1917 | Reynolds . | |
| 2,429,939 | 10/1947 | Masterson et al. . | |
| 2,563,407 | 8/1951 | Haims . | |
| 2,722,967 | 11/1955 | Reinholz . | |
| 3,591,173 | 7/1971 | Cossman . | |
| 4,367,870 | 1/1983 | Birch . | |
| 4,508,335 | 4/1985 | Kelley et al. | 482/140 |
| 4,527,833 | 7/1985 | Parker . | |
| 4,595,234 | 6/1986 | Kjersem . | |
| 4,729,562 | 3/1988 | Pipasik . | |
| 4,752,067 | 6/1988 | Colonello . | |
| 4,807,873 | 2/1989 | Naguin | 482/140 |
| 4,863,158 | 9/1989 | Tassone . | |
| 4,902,003 | 2/1990 | Buoni | 297/258 |
| 5,125,650 | 6/1992 | Paris | 482/140 |
| 5,368,537 | 11/1994 | Felice | 482/140 |
| 5,407,404 | 4/1995 | Killian et al. . | |
| 5,492,520 | 2/1996 | Brown | 482/132 |
| 5,577,987 | 11/1996 | Brown | 482/140 |

FOREIGN PATENT DOCUMENTS 3632-124A 9/1986 Germany .

*Primary Examiner*—Jeanne M. Clark
*Attorney, Agent, or Firm*—Sheridan Ross P.C.

[57] ABSTRACT

An abdominal exercise device and method is disclosed that is capable of isolating desired abdominal muscles. The present device is preferably made of bent tubular steel and is configured in a double U-shaped configuration whereby a user rests his/her neck on a fixedly adjustable neck support crossbar between opposing U-shape members and rests their upper arm regions on opposing armrests or on an A-frame structure above the user's head. The device is fixedly adjustable along various lengths by telescoping means that permit adjustment of the device to fit different physical morphologies and configurations. Moreover, armrests and hand grips are pivotally and/or rotatably mounted in order to accommodate personal comfort while using the present device. The present method relates to the use of the present device to strengthen abdominal muscles without injury to a person's spine and neck by alleviating undesired contraction of other abdominal muscles, such as the psoas muscles, and by maximizing isolated abdominal muscle contraction due to the unique cam design of a ground contracting member.

25 Claims, 12 Drawing Sheets

ABDOMINAL EXERCISE APPARATUS AND METHOD

FIELD OF THE INVENTION

The present invention relates to an abdominal exercise apparatus and method, and more particularly to an adjustable device capable of isolating the abdominal muscles of a person in performing a sit-up, curl, reverse curl or lateral curl.

BACKGROUND OF THE INVENTION

Abdominal muscles are used in all human motions, including breathing, sitting and standing. Strong abdominal muscles are crucial for torso stability, good posture and the avoidance of back problems. The primary abdominal muscle, erectus abdominous, controls the tilt of the pelvis and the consequent curvature of the lower spine. Other abdominal muscles reach around the back and play an important role in posture and back support. Several muscles have fibers aligned in different directions. For example, the internal and external obliques have anterior fibers that run vertically between the ribs and the pelvis. Due to the different directions in which such muscles are aligned, development and toning of such muscles is preferably attained by movement in more than one direction movement pattern. The transverse abdominous muscle is the chief muscle of forced expiration. Along with the erectus abdominous and external and internal obliques, the transverse abdominous is involved in holding the abdomen flat.

To properly condition the abdominal muscles, it is necessary that an exercise target the abdominals specifically and involve movements directly caused by the abdominal muscles. To attain desired conditioning, the abdominals must also be overloaded to force them to do more than they are typically accustomed to do. Finally, the abdominal muscles should be worked from a variety of angles to accomplish maximum muscle fiber involvement in muscle contraction.

A variety of conventional abdominal exercises have been touted as being effective. Straight-leg sit-ups, Roman chair sit-ups, pivoting seated apparatus and pre-formed plastic rocking devices are but a few of the multitude of exercise devices and machines used by individuals to firm and tone abdominal muscles. Because the abdominals have a substantially narrow range of motion, the above-referenced exercises and devices work muscles other than the abdominals, thus reducing the efficiency of the desired abdominal workout. Indeed, movement beyond an approximately 30 degree range must necessarily involve muscles other than the abdominals. In many of the abdominal exercise devices available today, the psoas magnus and psoas parvus muscles, which run down the front of the legs, up through the pelvis and attach to the lowest six spinal vertebrae, are contracted. These muscles pull a person's torso toward their legs and have a significant range of motion, flexing a person forward all of the way from a full back bend and back until a person's chest touches his/her knees. The psoas muscles compete with the abdominal muscles for the first third of a curling movement and then take over entirely after that point to complete the contraction of a person's chest toward their lower extremities. Moreover, significant damage to muscles and bones can be incurred from repeated psoas-dominated movements. The psoas muscles exert considerable force against the lower spine. To the extent exercises are performed while a person's back is arched, the vertebrae around the psoas attachment tend to grind together and may result in permanent lower back pain as a result of disk degeneration. As such, an exercise that specifically targets the abdominal muscles without substantially contracting other muscles, such as the psoas muscles, would be desirable. Proof that the abdominals are not being utilized efficiently is seen, for example, by athletes that perform several hundred Roman chair sit-ups in an attempt to obtain a sensation of "muscle burn" in their abdominal region.

While it is possible to perform correct anatomical positioning to achieve significant isolation of the abdominal muscles during an exercise, considerable training and care is required to perform such exercising consistently to both achieve maximum effectiveness and to avoid potential injury. For example, by performing exercises in which a quarter sit-up is performed, individuals often pull too strongly with their hands behind their head, thus placing unnecessary stress on the neck and shoulder muscles and often resulting in the arching of a person's back due to increasing muscle fatigue after several repetitions of the sit-up exercise. When a person places their hands behind their neck or head during a conventional sit-up or curl, it allows the arms to pull the head and neck into hyperflexion, stretching the posterior ligaments.

There is, therefore, a need for a safe and effective exercise apparatus that can properly configure a person's anatomical structure in order to maximize the proper conditioning of abdominal muscles without consequent undesired contraction of other muscles, such as the psoas muscles, while at the same time achieving desired movement without injuring a person due to improper positioning and/or stress on various body parts. There is also a need for an apparatus that can be easily adjustable to suit different physical body frames, that supports neck and shoulder muscles without strain during an abdominal exercise and that correctly and efficiently exercises the desired abdominal muscles in a manner that promotes the desired level of fatigue so that muscles can be toned and shaped in as short a time period as possible.

SUMMARY OF THE INVENTION

The present invention is directed to an abdominal exercise device and method that maximizes isolated abdominal muscle contraction due primarily to a unique cam design of a ground contacting member. The abdominal exercise device comprises a frame made of tubular material constructed from metal or hardened plastic, such tubular material having a generally double U-frame configuration. Two armrests are fixedly and adjustably attached to the tubular material on either side of the double U-frame configuration. A fixedly adjustable neck support is operatively connected to the tubular material by adjoining each side of the double U-frame configuration. The tubular material has a ground contacting curved portion having an arc of between about 65° and about 140°, more preferably about 120°, such cam design capable of maximizing contraction of targeted abdominal muscles to achieve optimal conditioning thereof.

The present device is adjustable by telescoping means located on various portions of the device such that different body configurations and morphologies can be accommodated. The armrests attached to the device are preferably pivotally mounted and/or rotatably mounted to further facilitate different preferences of users. The double U-frame configuration is connected at an apex having a substantially flat portion that is graspable by a user's hands. The neck support is adjustable by maneuvering a crossbar to which the neck support is attached. In a preferred embodiment, rotatable collars are fitted about the tubular material to accommodate hand holds for a user at appropriate areas of the configuration, thereby permitting a spectrum of negative resistance to be achieved through changing hand positions and thus leverage exerted, on the device. In a preferred embodiment, the U-shaped tubular material is bent at an angle of about 40° at a point closest to the armrest attachments, is bent at an angle of about 120° at a position where the tubular material contacts the ground and is bent at an angle of about 90° at a point where the tubular material extends upwards from the ground.

The present invention also relates to a method for exercising abdominal muscles using the device described above. Other advantages and objects of the present invention will be apparent from a review of the figures and detailed description as provided below.

DETAILED DESCRIPTION

The apparatus and method of the present invention is directed to isolating the abdominal muscles during the performance of contractual exercises of the abdomen. The present invention uses displaced variable resistance created by the arcuate motion of the unique apparatus when moving through the exercise. Use of the present invention provides a mechanical advantage in performance of abdominal exercises because it utilizes the anatomical leverage supplied by the configuration of the present apparatus as shown in the figures. The present apparatus allows for the abdominal muscles to be contracted so as to work at a small angle of pull. Increased strength is achieved in the abdominal muscles by providing an efficient resistance that isolates particular abdominal muscles rather than other undesired muscles in a person's body that may also be utilized in contractive exercises.

Figure 1:
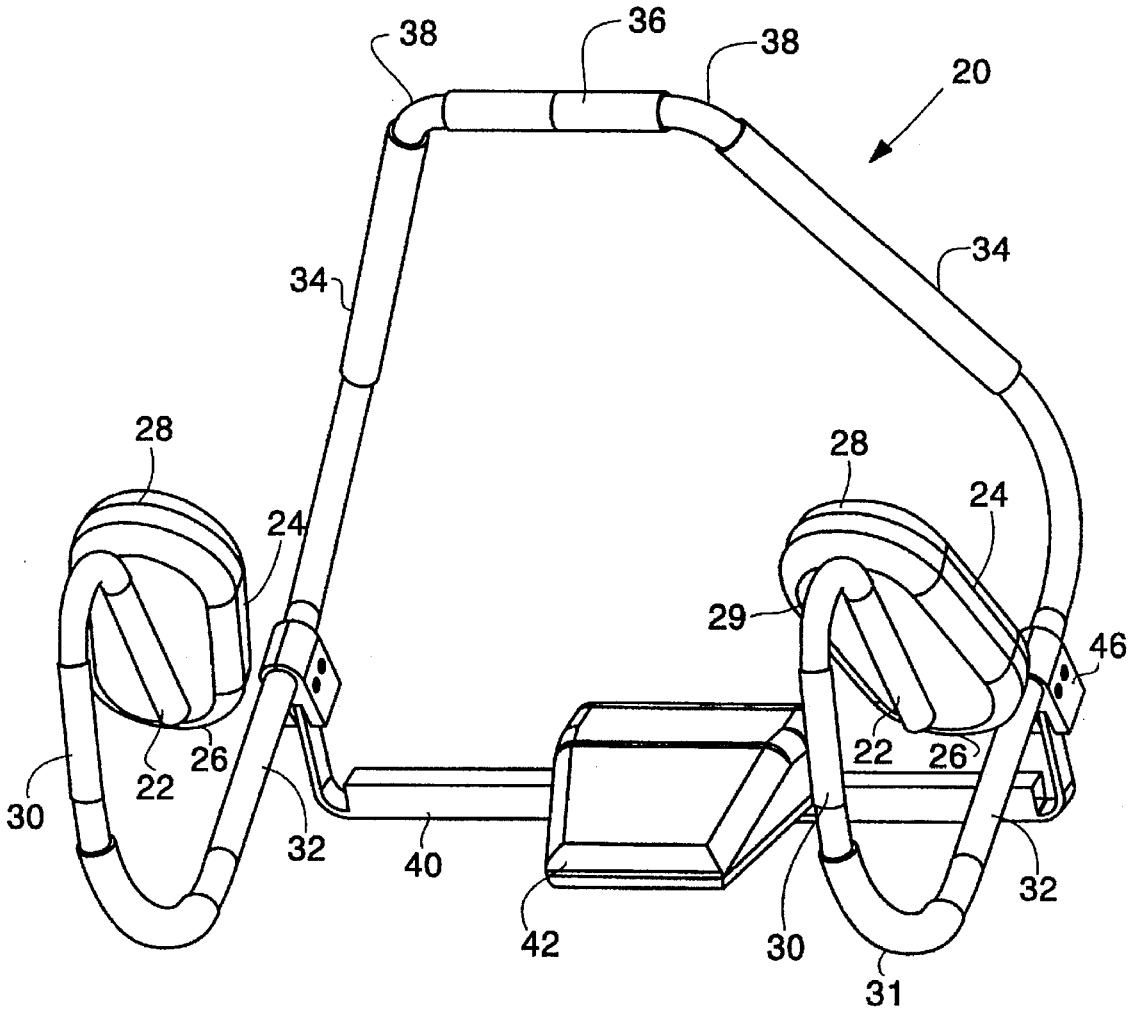
FIG. 1 is a perspective view of the present invention.
Figure 8A:
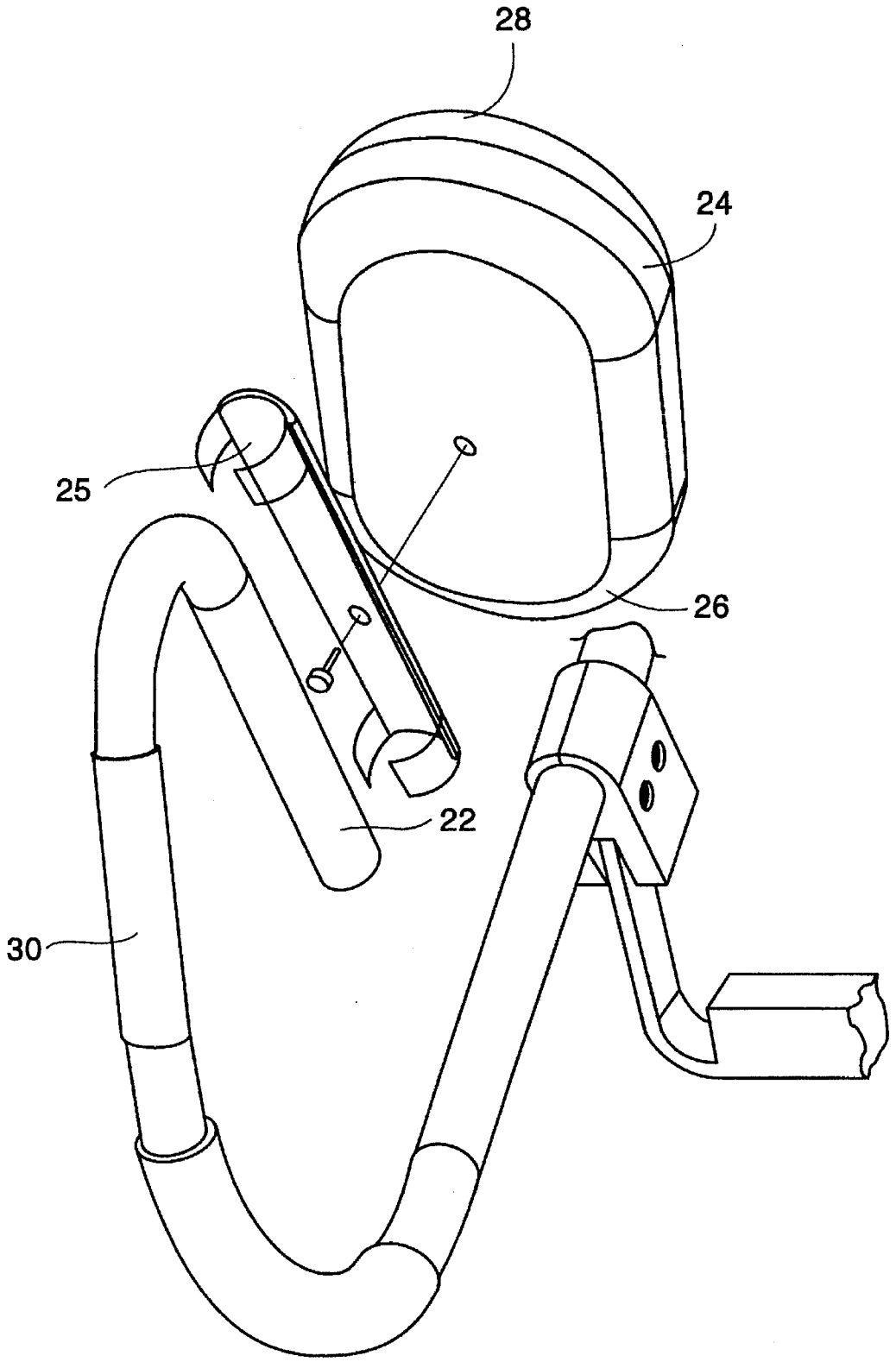
FIG. 8A shows an exploded view of an armrest showing a pivotal mounting bracket.
Figure 8B:
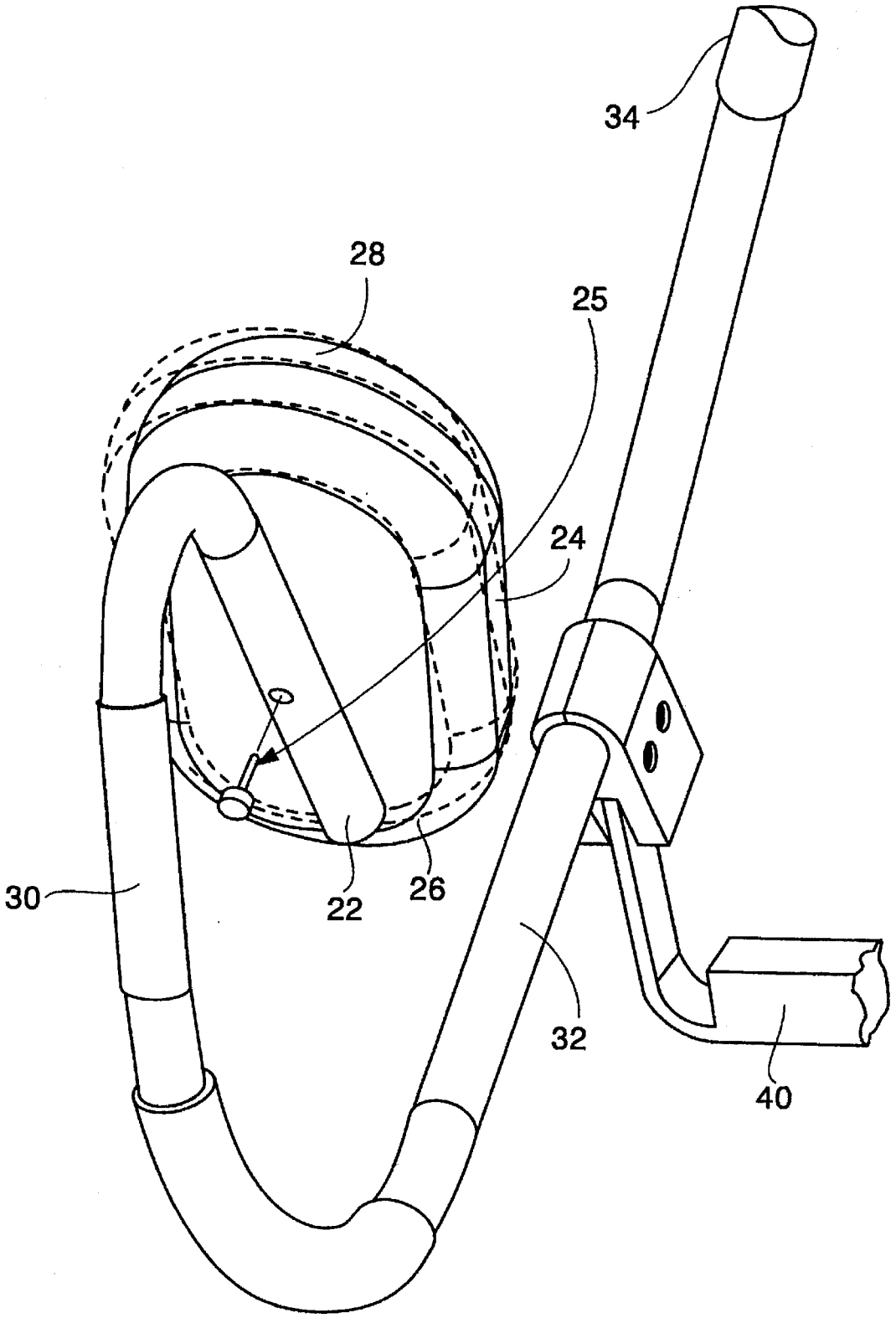
FIG. 8B shows the pivotal mounting of an armrest.
Figure 9:
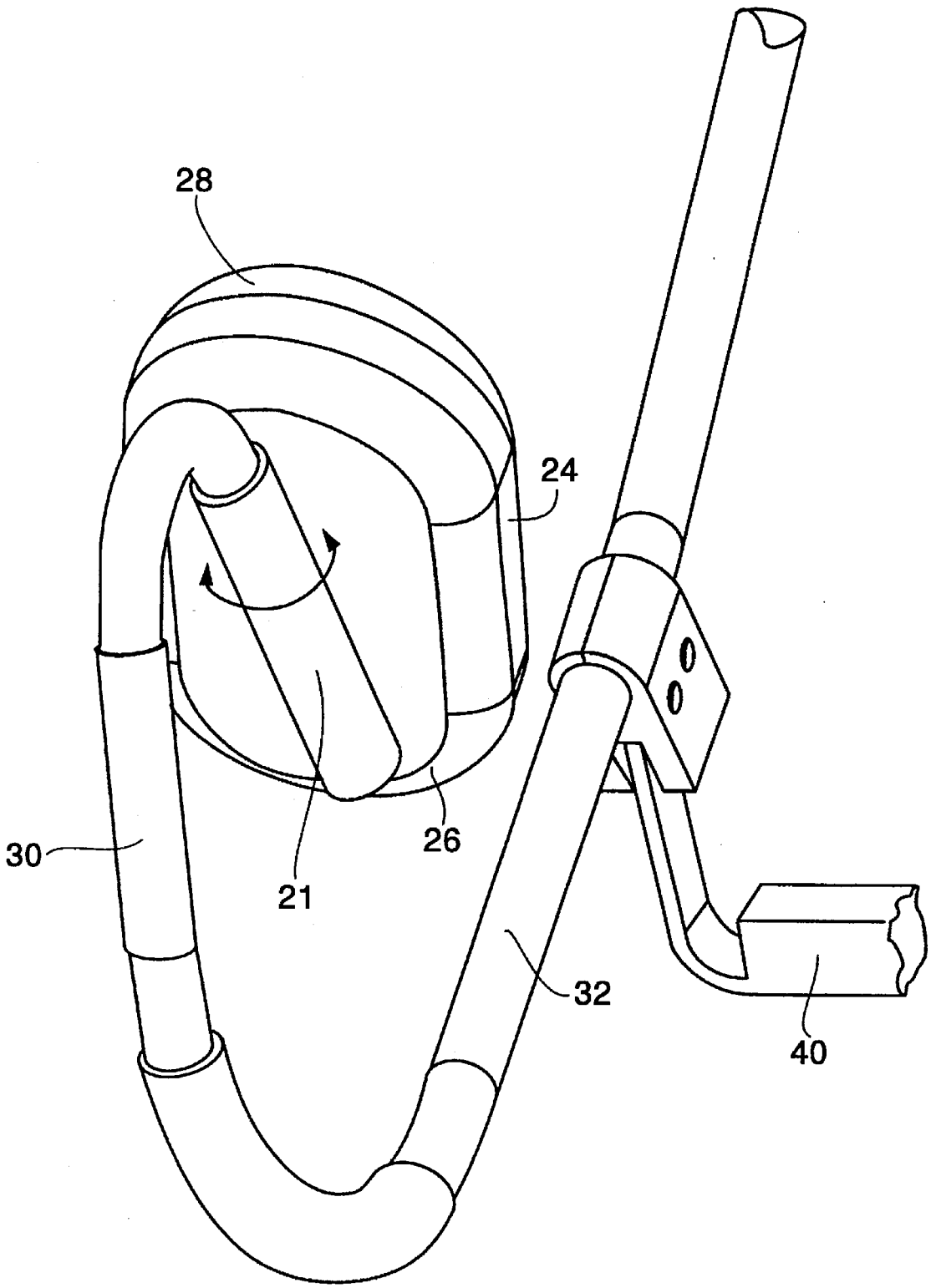
FIG. 9 shows the rotational mounting of an armrest.

In one embodiment, the present invention is shown in FIG. 1. The apparatus 20 is preferably configured in a substantially double U-shaped configuration (when viewed from its side) and can be formed from one length of tubular material, such as aluminum, steel, composite materials, or high density plastic (e.g., injected molded plastic). In describing the apparatus from one end of a bent configuration, a first portion 22 is provided that when in use, provides a platform upon which an armrest 24 can be attached to support a person's upper arm region, preferably the entire length of the upper arm region. The armrest 24 is preferably adjustable to accommodate different sized individuals and different positions of the upper arm region in relationship to the apparatus 20. For example, the armrest 24 can be pivotally mounted so that an individual's upper arm region can rest on the padded armrest 24 in lateral alignment with the upper arm region but out of alignment with the underlying tubular material 22 that supports the pivotally mounted armrest 24. The armrest 24 can alternatively, or in addition, be mounted so as to be rotatable about the exterior circumference of the supporting tubular material 22 to accommodate variations of the position of a person's upper arm regions on the device during the performance of a sit-up motion using the device 20. Various mounting means can be utilized to facilitate desired rotational and pivotal motion that will be apparent to one of skill in the art. For example, the armrest 24 can be mounted on the tubular material 22 by means of an adjustable sheath 21 that surrounds the tubular material 22 and is fixed to the bottom of the armrest 24 can rotate about the longitudinal axis of the tubular (see FIG. 9). In addition, a pivotal mounting bracket 23, can be connected to the bottom of the armrest 24 and the tubular material 22 to facilitate rotational movement of the armrest about an axis of rotation perpendicular to the longitudinal axis of the tubular material 22 (see FIGS. 8A and 8B). In this manner, the armrest 24 can be appropriately adjusted for each individual's preferences and body shape and configuration.

From the back end 26 of the armrest extending to the front end 28 of the armrest, the underlying tubular material 22 is relatively flat' to accommodate the armrest. At approximately the front end of the armrest 28, however, the tubular material is curved in a substantially sharp angle 29. Thereafter, the tubular material is configured into an approximate U-shape that first extends in a vertical downward direction 30 and thereafter extends in a relatively straight line along the bottom portion of the U-shape 32 and, thereafter, is bent upwards vertically 34 to an apex 36 (e.g., completing the U-shaped side-perspective of the device).

Figure 10:
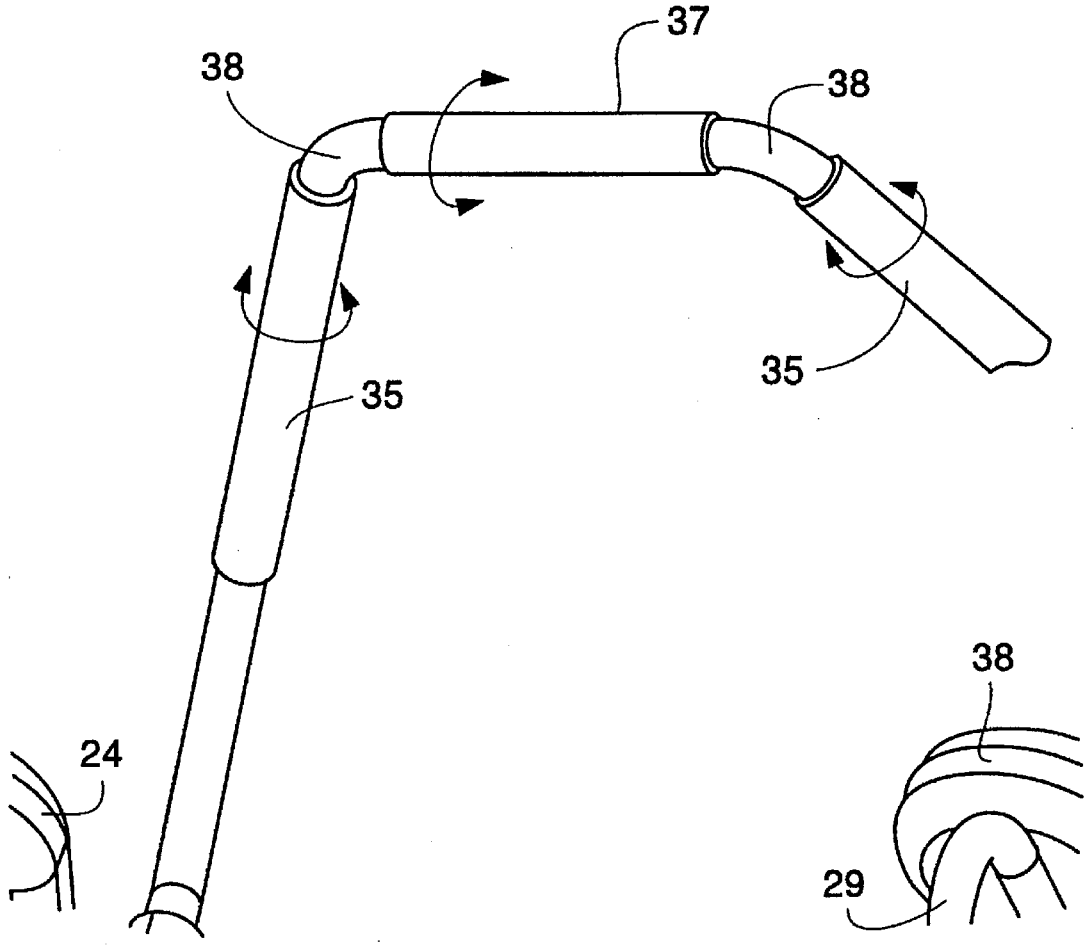
FIG. 10 shows an embodiment utilizing rotatable collars.
Figure 11:
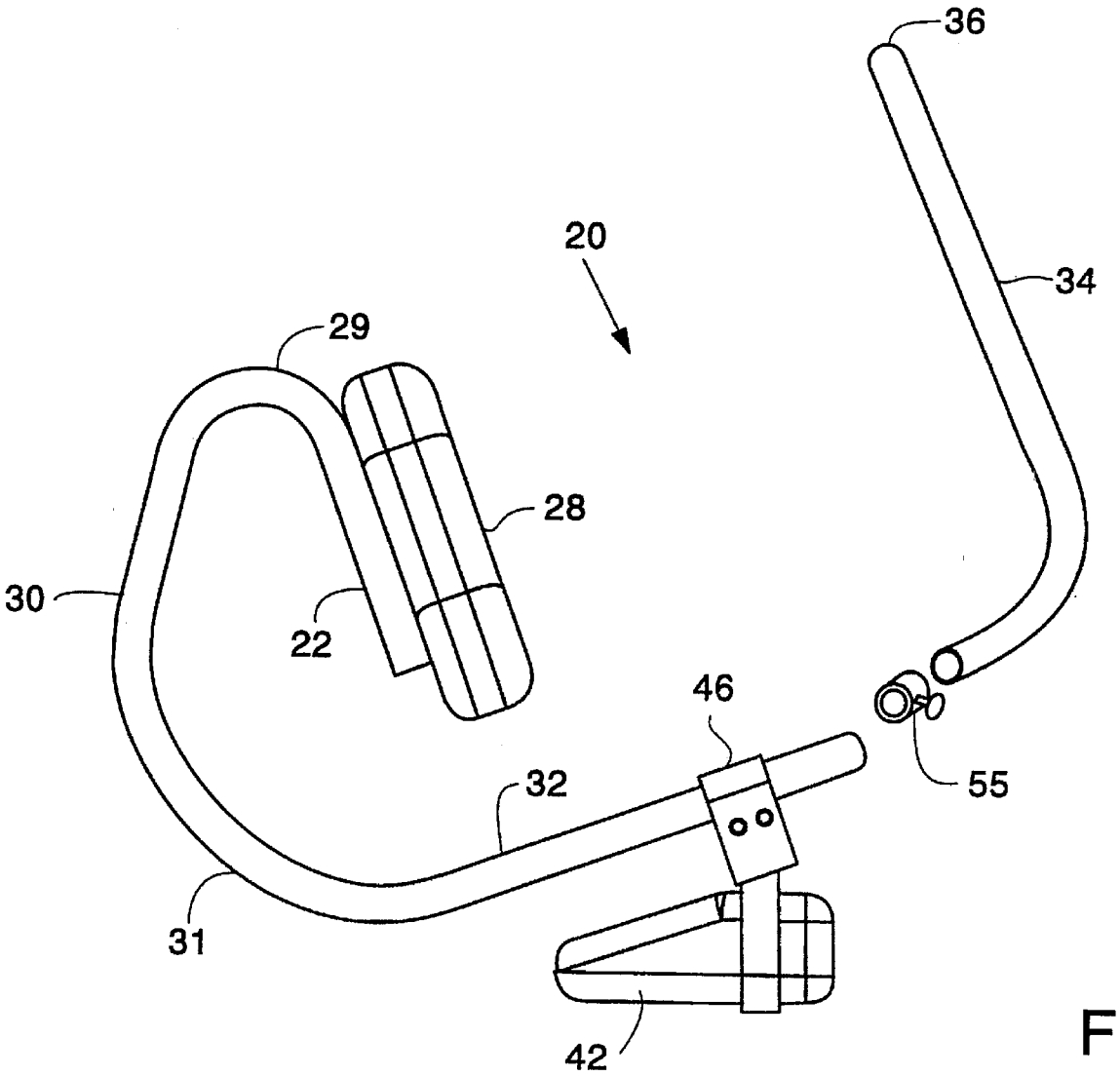
FIG. 11 shows a side view of the device where a locking collar is used to adjustly lack together different portions of the device.

At the apex 36, a preferred embodiment has a relatively sharp bend of tubular material 38 to form a flat portion 36 that can accommodate gripping by both hands of the user. As shown in FIG. 10, a loose fitting sheath 37 preferably encircles the apex 36, (such apex preferably having a flat portion) to thereby provide a hand grip for a user of the apparatus, such sheath being slidably rotatable about a longitudinal axis of the apex 36 to thereby accommodate rotation of the flat portion 36 within the sheath during operation of the device 20.

In a similar fashion, the tubular material forming the upward vertical portion (i.e., side rail 34) of the device 20 can similarly be encircled by a sheath similar to that described above to thereby provide a rotatable hand grip 35 (see FIG. 10) for the user of the device.

The above description describes one side of the apparatus which is identical to the opposing side of the apparatus 20, in between which a person is positioned so that he/she can lie supine and rest their upper arm regions on the opposing armrests 24.

Figure 2:
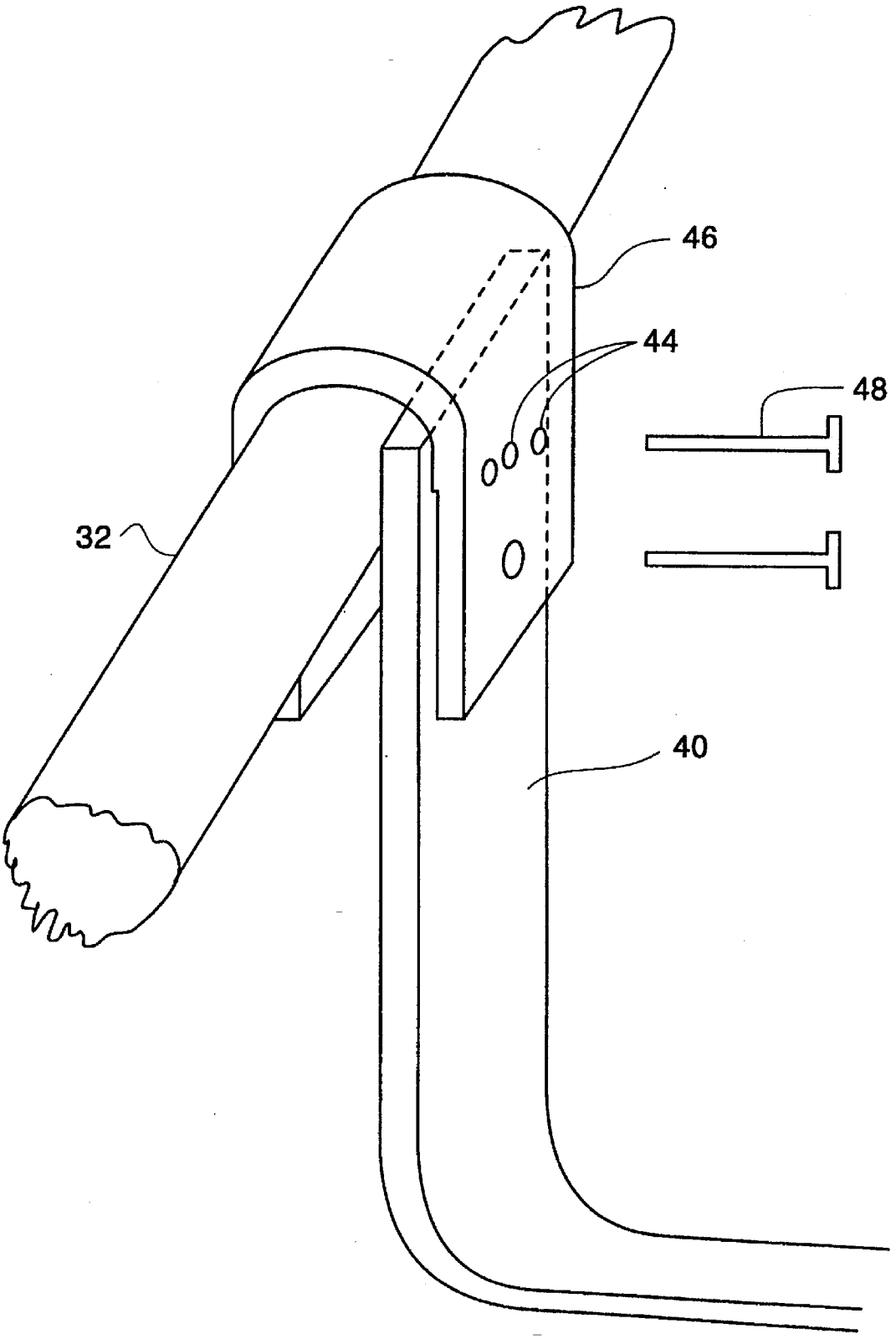
FIG. 2 is a partial view of the brace for the neck support crossbar, illustrating how it can be adjusted to various fixed angle positions.

On the lower portion of the U-shaped tubular configuration 32, a crossbar 40 is provided having a neck supporting structure 42 positioned intermediate on the crossbar 40. The neck support 42 is preferably fixed in a static position so that it does not rotate or pivot, thereby firmly supporting the user's head in a proper position throughout the movement of the person's body when performing the sit-up/curl exercise. Even more preferably, the neck supporting means 42 is fixedly adjustable to accommodate different sized individuals and different angled neck/body configurations. As shown in FIG. 2 this can be achieved, for example, by a series of apertures 44 that extend through a brace 46 for the crossbar 40, such apertures 44 being accessed by a pin 48 extending through the crossbar support 40 and through the brace 46 to fix the position of the neck support 42 at a desired angle.

Figure 3:
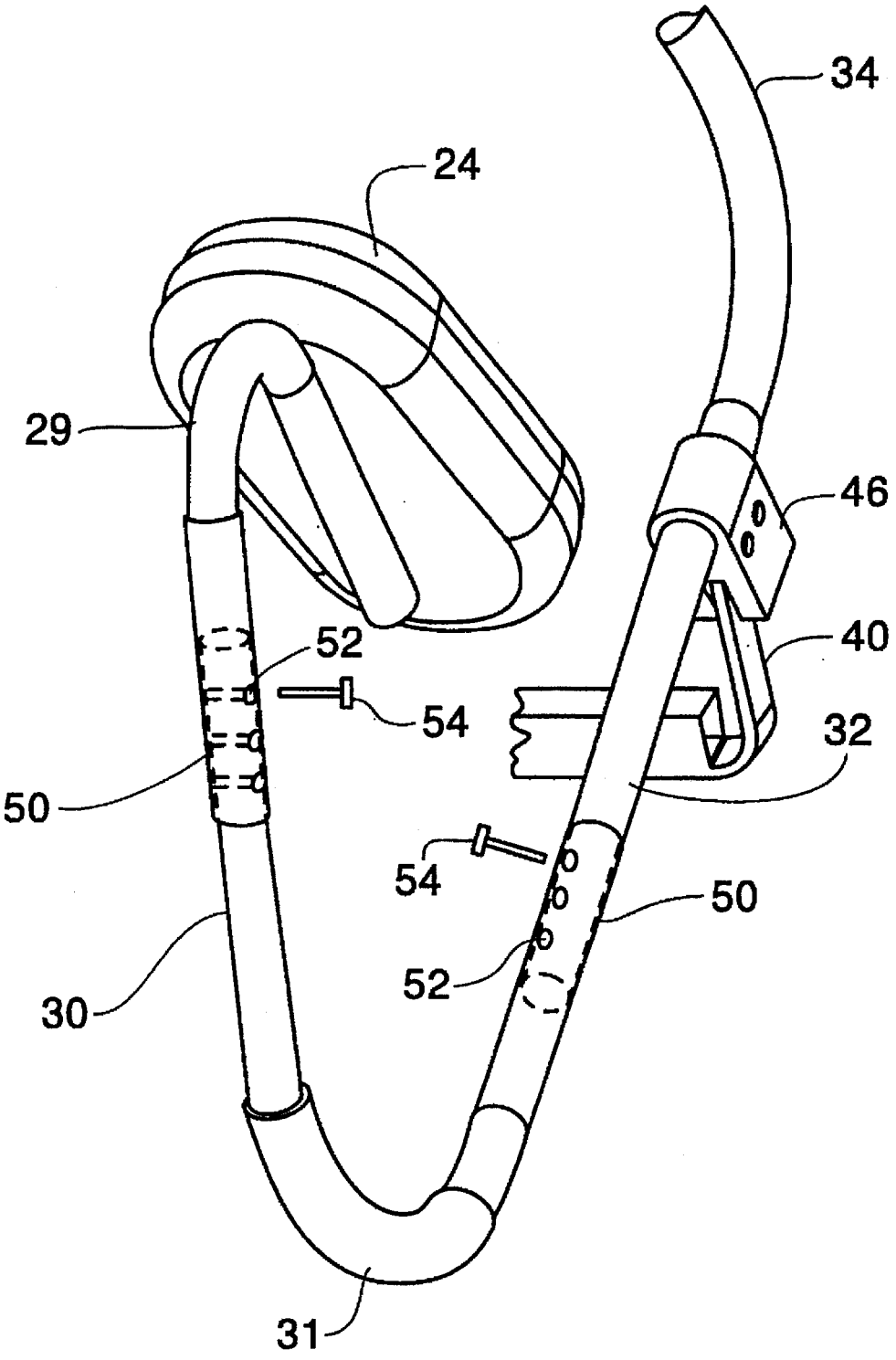
FIG. 3 is a partial view of one side of the present device showing telescoping members capable of adjusting the configuration of the present device for different size individuals.
Figure 7:
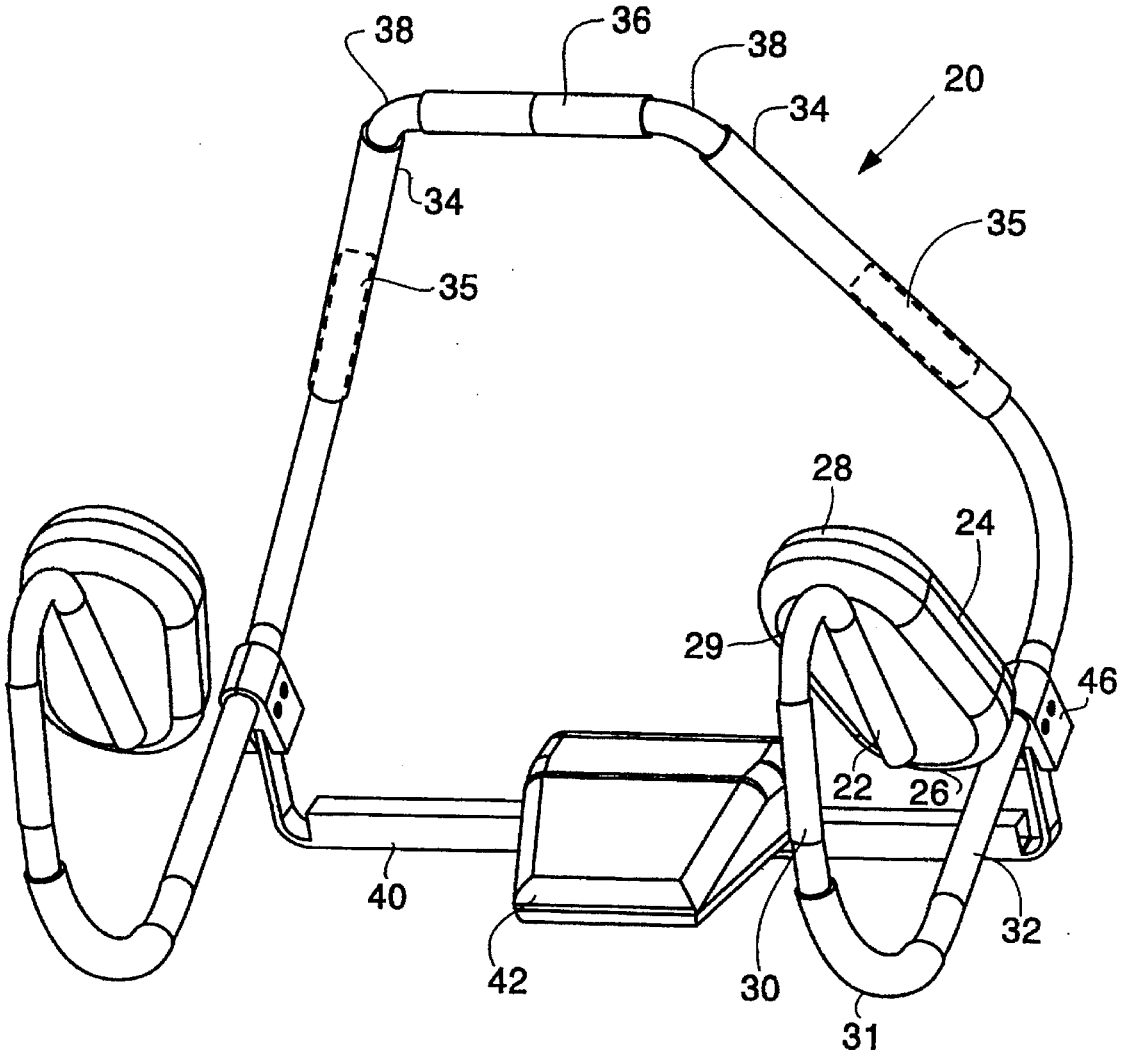
FIG. 7 is a perspective view of the present device showing telescoping members toward the upper portion of the device to accommodate different sized individual users.

In one embodiment shown in FIG. 3, the apparatus 20 is adjustable for different sized individuals by means of a telescoping tubular member 50 provided at various points along the U-shaped tubular material, for example along the vertical downward portion of the cam 30 or along the bottom portion 32 thereof. FIG. 7 shows a further portion of the device 20 that can have telescoping means 35. For example, in reference to FIG. 3, a telescoping connection 50 can be provided in the lower part of the U-shaped tubular structure, such telescoping member fixedly adjustable by means such as a aperture/pin arrangement as described above, such apertures 52 provided in each counterpart of the telescoping tubular material 50 so that a pin 54 car be inserted therethrough. In such a manner a large person can extend the length of the device to accommodate his/her body frame, thus providing for a proper configuration to maximize contraction of the targeted abdominal muscle. The degree of overlap of the telescoping members 50 should be suitable to promote the desired rigidity of the apparatus, given the significant forces involved during the sit-up/curl exercises. Other means for adjustably fixing the telescoping members in fixed relation to each other can be utilized, for example a locking collar 55 can be used to adjust the length of either telescoping section 50, 35 and can be tightened to fix a desired position of the telescoping members 50, 35.

An important feature of the present invention relates to the bent configuration of the tubular material at a point where the device 20 contacts the ground. It is at this point that the tubular member is substantially straight or only curved to a minor degree and as such, can be viewed as a "cam" in relation to the sharp angles abutting this region 29, 31. This animated curve 30, otherwise referred to herein as a cam, carries the body weight of the user, such body weight acting as negative resistance during the exercise, and thus provides for an isometric resistance. At a starting position where an operator's head is cradled by the neck support and the person is lying supine with abdominal muscles extended, the device is moved from a position of no resistance, followed by an increasing amount of resistance as the user contracts stomach muscles to roll the present device about the curve 31. The user's weight acts as negative resistance during such motion. Such motion continues until stomach muscles are further contracted and the device is rolled through until the relatively flat portion of the device 30 is in contact with the ground. At such point the maximum resistance is achieved and stomach muscles are fully contracted, thereby providing for maximum muscle exercise and contraction. The cam 30 thus displaces the negative resistance and mimics the muscle action potential, otherwise known as a mapping effect, and moves the muscle from a point of no resistance to a point of peak resistance, thereby contracting the muscle from its natural relaxed state to its maximum contractive state, thus permitting muscle breakdown and exhaustion and affording the necessary exercise of the muscle to promote growth and conditioning.

In contrast to other devices, the present inventors are the first to appreciate the importance of the cam feature 30, considered essential to the desired exercise movement required to effectively condition and isolate abdominal muscles. Other devices utilize ground contracting surfaces that are too curved, thus making the exercise easier for the user, but defeating the purpose of adequately fatiguing the muscle at appropriate points during the contraction of the muscle. The present invention allows for the isolation of a peaking potential of the muscle, meaning the full contraction of the muscle, to attain the full benefit of the exercise. Using the present device, abdominal muscles are targeted to statically and consistently contract the muscle to its peak, thereby breaking the muscle down to its fullest extent and then returning it to its natural shape. Full expansion and full contraction of desired abdominal muscles is therefore obtained by using the particular cam design of the present invention.

The cam acts as a range of motion device to allow muscles to contract to their fullest capability and to relax to their fullest capability. Prior devices which utilize a more curved ground contacting portion do not afford the negative resistance required to fully exercise the muscle, thus causing the user to fail to achieve the full benefit of the exercise. The cam configuration of the present device provides for a working of abdominal muscles including the upper, the lower, the hip flexors and the psoas, whereas prior art devices work primarily only the upper abdominals. The particular muscles worked by the present invention include the obliquus internus, quadratus lumborum, obliquus externus, the psoas (to a limited extent), the hip flexors, the rectus abdominous and the transverse abdominous. Various obliquue muscles can be exercised by moving the user's legs to a side position to further isolate such muscles.

Figure 4:
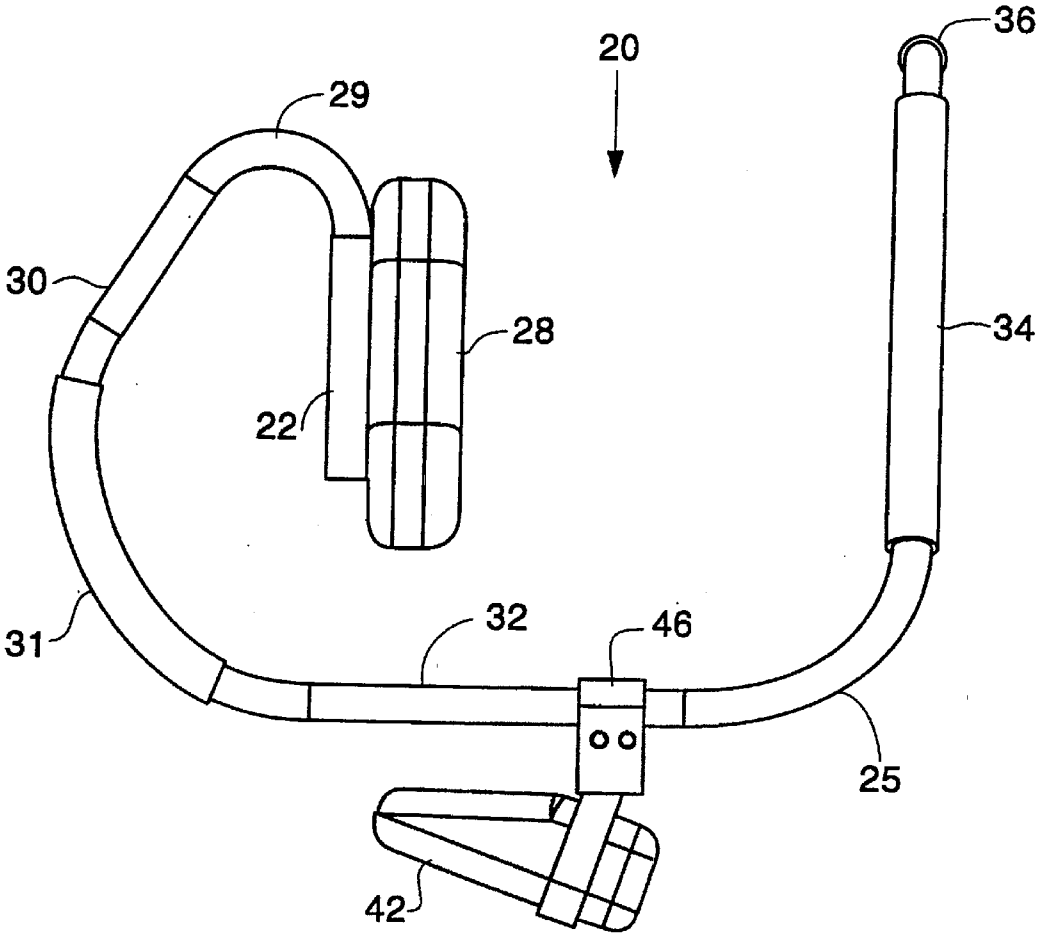
FIG. 4 is a side view of the present device.
Figure 5:
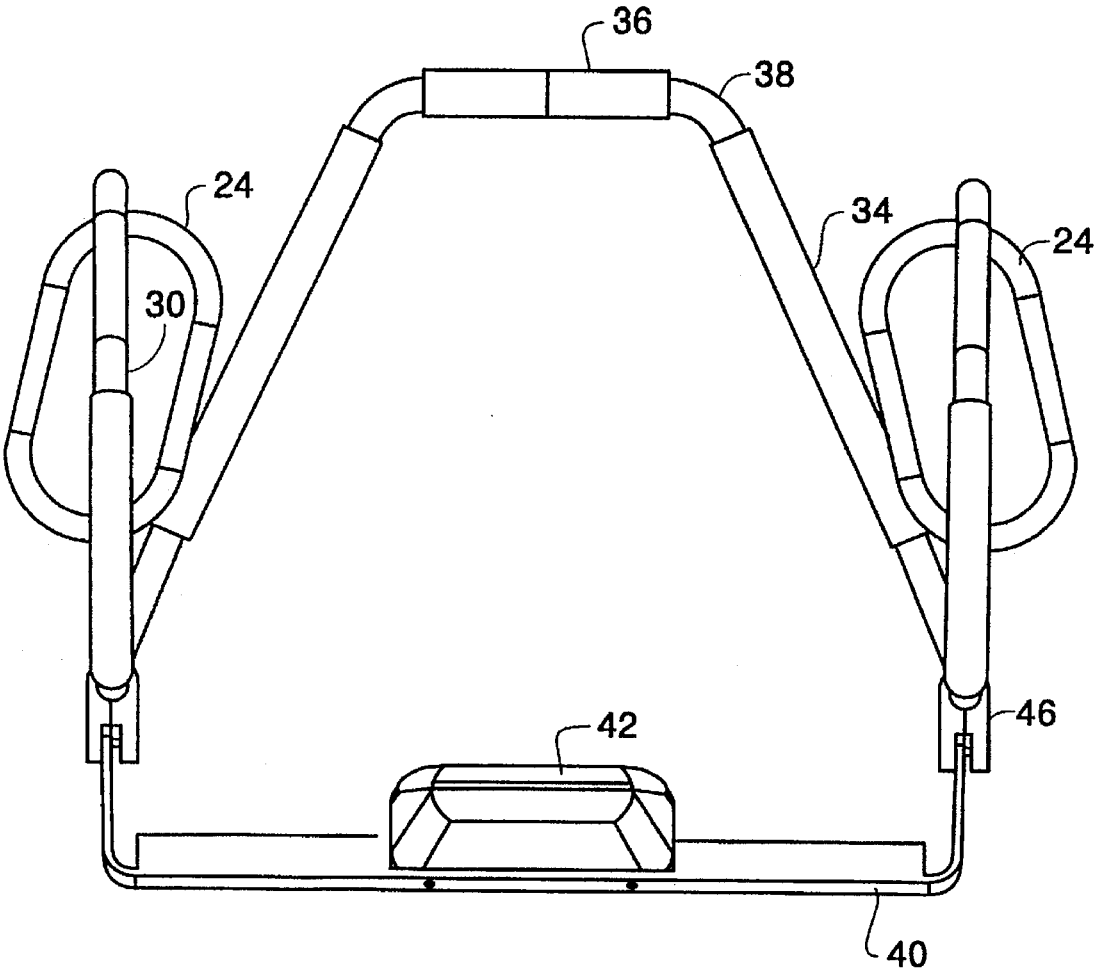
FIG. 5 is a perspective bottom view of the present device.
Figure 6:
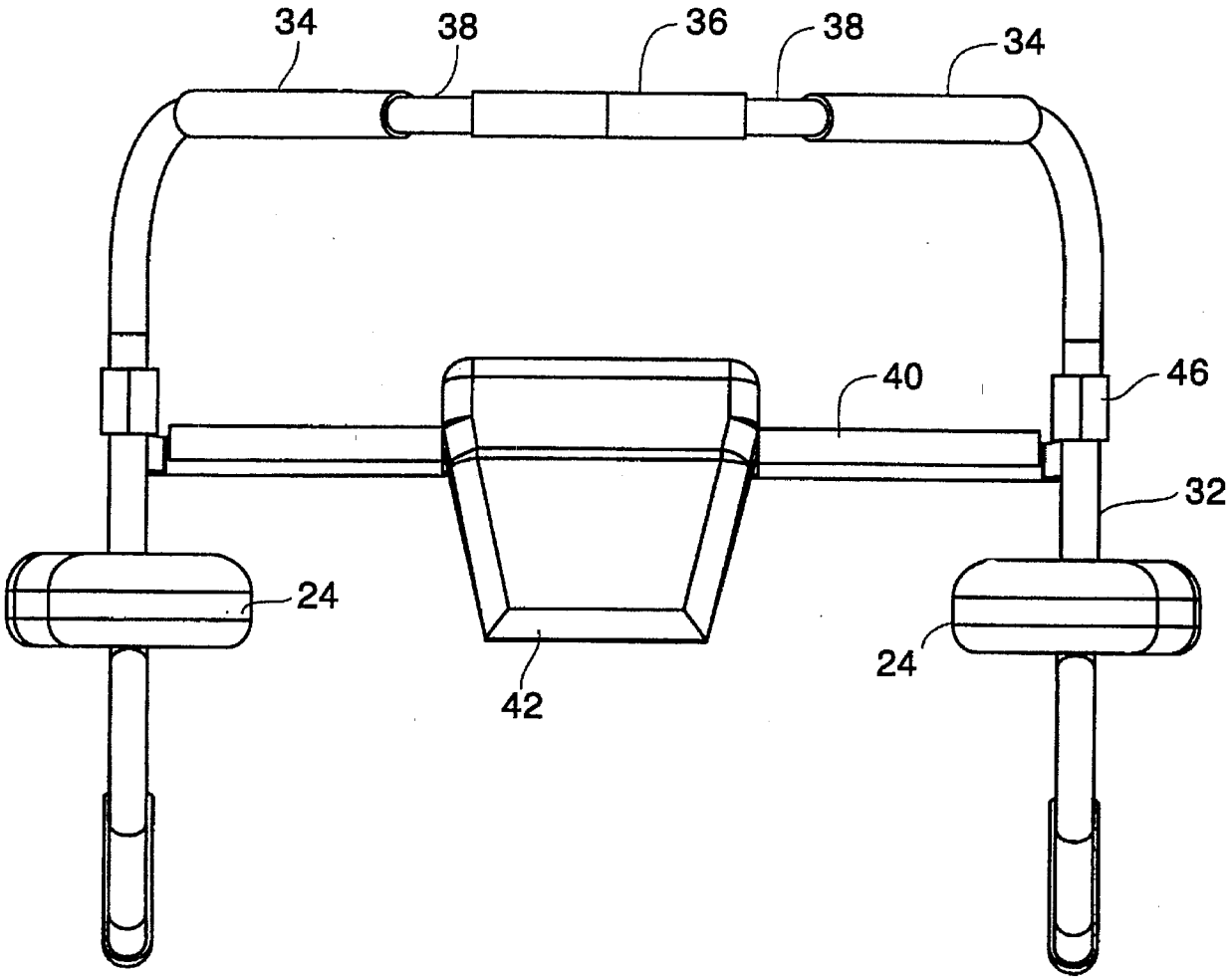
FIG. 6 is a top view of the present device.

To achieve the desired shape of the tubular material in the cam region, proper angles are formed of the tubular material at curve 31 and at curve 29. Preferred ranges of the angle 29 are from between about 20° and 60°, and more preferably about 35°. The elongated curved effect of the cam is preferably of a particular arc that produces the desired resistance over the range of motion during the sit-up or curl exercise. The arc measurements of the curve 31 should preferably be between about 45° and about 80°, and more preferably about 60° (e.g., the angle formed by extending imaginary lines running through the longitudinal axis of 30 and 32 to an intersection point, see FIG. 4). The angle 25 (see FIG. 4) is preferably bent at about a 90° angle but can be bent between about 60° to about 120°. Angle 38 is preferably bent to about a 90° to 120° angle, preferably about a 120° angle.

In operation, a person lies on their back between the armrests 24 of the device 20 and rests their head on the neck support cushion 42 centrally located on the crossbar 40. The crossbar 40 is adjusted to a preferred angled position for the particular user's neck. The exercise can include bringing the user's knees up into a bent position with knees together and arms positioned either on the fixedly adjustable armrests 24 or on the side rails 34 or the apex 36 of the device 20, depending upon the level of conditioning of the user. For example, a beginner may grip the apex 36 of the device 20 to provide more angular leverage to assist in performing the sit-up or curl exercise. More advanced individuals will be able to provide more negative resistance in performing the exercise by gripping the side rails 34. Moreover, the present device 20 is adjustable along the various telescoping members 35, 50 to fit the particular user's morphology or preferences. Contraction of a user's stomach muscles moves the device through a range of motion over the cam area 30 in order to isolate the abdominal region. Most of the resistance is then transferred to the frame of the device 20, such device acting as an exoskeleton operable by a user's abdominal muscles. Once reaching the cammed flat curved point 30 in the range of motion the muscle is essentially held in the contracted position for a period of time, thus providing for muscle breakdown and exhaustion through repeated sit-up or curl exercises.

The present device alleviates concerns involving support for the neck and for proper positioning of the spine during sit-up curl exercises, and thereby allows for the isolation of abdominal muscle contractions. Reverse crunches can also be performed using the apparatus by keeping the spine firmly contacted with the ground and lifting legs either separately or together up and towards the user's chest.

The foregoing description of the invention has been presented for purposes of illustration and description. Further, the description is not intended to limit the invention to the form disclosed herein. Consequently, variations and modifications commensurate with the above teachings and the skill or knowledge in the relevant art are within the scope of the present invention. The preferred embodiment described hereinabove is further intended to explain the best mode known of practicing the invention and to enable others skilled in the art to utilize the invention in various embodiments and with various modifications required by their particular applications or uses of the invention. It is intended that the appended claims be construed to include alternative embodiments to the extent permitted by the prior art.

What is claimed is:

1. An abdominal exercise device, comprising:

a frame comprised of tubular material having a generally double U-frame configuration that includes a substantially vertical downward portion having a first longitudinal axis and a bottom portion having a second longitudinal axis, said frame having a curved portion operatively connecting said vertical downward portion and said bottom portion, wherein an angle formed by extending imaginary lines running through said first longitudinal axis and said second longitudinal axis to an intersection point is between about 45° and about 80°;

two armrests fixedly attached to said tubular material to accommodate the upper arm region of a user when the user is in a supine position between said double U-frame configuration;

a neck support operatively connected to said tubular material in a fixed position by adjoinment to said double U-frame, said neck support firmly supporting the user's head throughout the movement of the user's head when performing a sit-up/curl exercise using said device.

2. The device of claim 1, wherein said frame has a telescoping means.

3. The device of claim 1, wherein said armrests are pivotally mounted with respect to said tubular material to facilitate movement about an axis of rotation perpendicular to said second longitudinal axis of said tubular material.

4. The device of claim 1, wherein said armrests are rotatably mounted so that said armrests can rotate about said second longitudinal axis of said tubular material.

5. The device of claim 1, wherein said double U-frame configuration is connected at an apex, said apex having a substantially flat portion graspable by a user's hands.

6. The device of claim 1, wherein said neck support is fixedly adjustable to a desired angle to accommodate different angled neck/body configurations.

7. The device of claim 1, further comprising rotatable collars fitted about said tubular material to accommodate hand holds for a user, said collars comprising a sheath surrounding said tubular material.

8. The device of claim 1, wherein said U-shaped tubular material is bent at an angle of about 35° at a point closest to said armrest attachments, is bent at an angle of about 60° at a position closest to said bottom portion, and is bent at an angle of about 90° at a point closest to said vertical portion.

9. The device of claim 1, wherein said neck support further comprises a crossbar, a brace and a series of apertures extending through said brace for said crossbar, said apertures being accessed by a pin extending through said crossbar and through said brace to fix the position of said neck support at a desired angle.

10. The abdominal exercise device of claim 1, wherein said tubular material is made from a material selected from the group consisting of metal and hardened plastic.

11. The device of claim 1, wherein said frame is adjustable to accommodate different physical body frames of a user.

12. An abdominal exercise device as set forth in claim 1, wherein said frame has a substantially upward vertical portion bent at an approximately 90° angle with respect to said second at an end opposite of said curved portion.

13. A method of exercising abdominal muscles comprising:

providing a device including double U-frame having a substantially vertical downward portion including a first longitudinal axis and a bottom portion including a second longitudinal axis, said frame having a curved ground contacting member operatively connecting said vertical downward portion and said bottom portion, wherein an angle formed by extending imaginary lines running through said first longitudinal axis and said second longitudinal axis to an intersection point is between about 45° and about 80°, and having armrests attached to said frame;

adjusting a neck support operatively connected to said frame so that said neck support is in a fixed position;

positioning a user's body so that said user's head rests on said neck support and said upper arms contact said armrests and positioning said frame with said curved member contacting the ground with an angle of about 60° at the start of an abdominal exercise; and moving said device to a forward position by contraction of said user's abdominal muscles whereby a significant portion of said ground contacting member contacts the ground during said moving step.

14. The method as set forth in claim 13, wherein said step of moving comprises moving said device through a range of motion over said curved member, said substantially vertical downward straight portion capable of contacting the ground subsequent to said curved member contacting the ground when the device is moved forward by contraction of a user'abdominal muscles.

15. The method as set forth in claim 13, wherein said step of positioning comprises said user being in an initial supine position and said curved ground contacting member being in contact with the ground.

16. An abdominal exercise device comprising:

a frame having a double U-frame configuration comprised of tubular material having a cam including a curved portion and a relatively flat portion adjacent to said curved portion, said cam has an angle from between about 20° and 60°, said angle measured by extending imaginary lines running through longitudinal axes of tubular portions adjacent to and on opposite sides of said cam, wherein said imaginary lines intersect at a point defining a vertex of said angle, and wherein said curved portion is configured to be capable of contacting with the ground at the start of an abdominal exercise and said flat portion is configured to be capable of contacting the ground when a user has substantially fully contracted their abdominal muscles;

an armrest attached to said tubular material to accommodate the upper arm region of the user when the user is in a supine position between said double U-frame configurations; and a neck support operatively connected to said tubular material, said neck support firmly supporting the user's head throughout the movement of the user's body when performing a sit-up/curling exercise using said device.

17. An abdominal exercise device comprising:

a frame having a double U-frame configuration comprised of tubular material having a cam including a curved portion and a relatively flat portion adjacent to said curved portion, said cam has an angle of about 60°, said angle measured by extending imaginary lines running through longitudinal axes of tubular portions adjacent to and on opposite sides of said cam, wherein said imaginary lines intersect at a point defining a vertex of said angle, and wherein said curved portion is configured to be capable of contacting with the ground at the start of an abdominal exercise and said flat portion is configured to be capable of contacting the ground when user has substantially fully contracted their abdominal muscles;

an armrest attached to said tubular material to accommodate the upper arm region of the user when the user is in a supine position between said double U-frame configurations; and a neck support operatively connected to said tubular material, said neck support firmly supporting the user's head throughout the movement of the user's body when performing a sit-up/curling exercise using said device.

18. An abdominal exercise device, comprising:

a frame comprised of tubular material having a generally double U-frame configuration that includes a substantially vertical downward portion having a first longitudinal axis and a bottom portion having a second longitudinal axis, said tubular material having a ground contacting curved portion having an arc of between about 45° and about 80°, wherein said arc is measured by an angle formed by extending imaginary lines running through said first longitudinal axis and said second longitudinal axis to an intersection point; and a neck support operatively connected to said tubular material in a fixed position by adjoinment to said double U-frame, said neck support firmly supporting the user's head throughout the movement of the user's head when performing a sit-up/curl exercise using said device.

19. The device of claim 18, wherein said neck support comprises a crossbar and a brace, said crossbar being connected to said brace having apertures extending therethrough, said apertures being accessed by a pin which fixes the position of said neck support at a desired angle, said crossbar being adjustable by maneuvering said crossbar to accommodate different angled neck/body configurations.

20. The device of claim 18, wherein said frame is adjustable to accommodate different physical body frames of a user.

21. An abdominal exercise device as set forth in claim 18, wherein said frame has a substantially upward vertical portion bent at an approximately 90° angle with respect to said second longitudinal axis.

22. The device as set forth in claim 18, wherein said frame has adjustment means including a locking collar operatively associating a first portion of the frame with a second portion of a frame, said collar being adjustable to fix said portions in relation to each other.

23. The device as set forth in claim 22, wherein said second portion is connected to said neck support.

24. The device as set forth in claim 22, wherein said first and second portions are moveable with respect to each other to extend the length of said frame.

25. The device as set forth in claim 22, wherein said first and second portions are telescopically moveable with respect to each other.

* * * * *